US007652553B2

(12) United States Patent
Neilly et al.

(10) Patent No.: US 7,652,553 B2
(45) Date of Patent: Jan. 26, 2010

(54) THERMALLY ACTIVATED ELECTRICAL INTERRUPT SWITCH

(75) Inventors: William C. Neilly, Palm City, FL (US); Kevin L. Gabrey, Port St. Lucie, FL (US)

(73) Assignee: Thermal Interrupt Devices, Ltd., Palm City, FL (US)

( * ) Notice: Subject to any disclaimer, the term of this patent is extended or adjusted under 35 U.S.C. 154(b) by 0 days.

(21) Appl. No.: 12/136,179

(22) Filed: Jun. 10, 2008

(65) Prior Publication Data

US 2009/0302991 A1 Dec. 10, 2009

(51) Int. Cl.
*H01H 71/18* (2006.01)
*H01H 37/46* (2006.01)
*H01H 37/44* (2006.01)
*H01H 37/74* (2006.01)

(52) U.S. Cl. ..... 337/384; 337/393; 337/123; 337/382; 337/388; 337/315

(58) Field of Classification Search ..... 337/315, 337/123, 393, 382, 384, 388
See application file for complete search history.

(56) References Cited

U.S. PATENT DOCUMENTS 2,764,027 A * 9/1956 Otto ..... 74/2
2,883,490 A * 4/1959 Larson ..... 337/126
3,356,816 A * 12/1967 Clarke ..... 337/75
3,768,925 A 10/1973 Klemm
4,245,142 A * 1/1981 Bauer et al. ..... 200/332
4,270,694 A 6/1981 Knauth
4,275,432 A * 6/1981 Napiorkowski ..... 361/124
4,357,589 A * 11/1982 Payne ..... 337/315
4,368,449 A * 1/1983 Ubukata ..... 337/313
4,389,629 A * 6/1983 Saur et al. ..... 337/126
4,391,093 A * 7/1983 Gulick ..... 60/794
4,479,039 A * 10/1984 Payne ..... 200/406
4,524,343 A * 6/1985 Morgan et al. ..... 337/140
4,610,603 A 9/1986 Norman
4,646,195 A 2/1987 Lisauskas
5,145,322 A 9/1992 Senior, Jr. et al.
5,656,986 A * 8/1997 Sassone et al. ..... 337/116
5,771,742 A * 6/1998 Bokaie et al. ..... 74/2
5,779,460 A 7/1998 Marz
5,828,287 A 10/1998 Nilson
6,255,934 B1 * 7/2001 Gadini et al. ..... 337/393
6,837,688 B2 1/2005 Kimberlin et al.
6,910,342 B2 * 6/2005 Berns et al. ..... 62/164
2003/0151478 A1 * 8/2003 Radosavljevic et al. ..... 335/18

* cited by examiner

*Primary Examiner*—Jayprakash N Gandhi
*Assistant Examiner*—Bradley H Thomas
(74) *Attorney, Agent, or Firm*—Gold & Rizvi, P.A.; Glenn E. Gold; H. John Rizvi

(57) ABSTRACT

A thermally activated electrical interrupt device incorporates a thermally activated portion (110) engaging with an electrical interrupt portion (120). The thermally activated material (114) expands when heated, causing an interrupt control rod (140, 180) to open an electrical contact (123, 125, 126/132, 134). When the interrupt device is placed into an interrupt state, a reset mechanism maintains the interrupt control rod (140) in the interrupt state until specifically reset.

17 Claims, 20 Drawing Sheets

THERMALLY ACTIVATED ELECTRICAL INTERRUPT SWITCH

BACKGROUND OF THE INVENTION

1. Field of the Invention

The present invention relates generally to an electrical interrupt device. More particularly, the present invention relates to a thermally activated electrical interrupt device for thermal protection of pumps, related piping and equipment.

2. Description of the Prior Art

A generic thermal switch device is known in the prior art. The general concept provides a thermally reactive material, which causes an electrical circuit to open when the temperature of the thermal material is elevated above a predetermined temperature. Several teachings utilize an actuator, which moves axially based upon an increase in heat to the device, to separate the electrical communication between a cantilevered contact member and a second, stationary contact member. When cooled, the actuator returns to a normal state, closing the electrical communication between the cantilevered contact member and the second, stationary contact member.

The thermal switches are limited whereby, the known devices allow the system to cycle between a thermally alarming and thermally acceptable state. This can continue until recognized and respectfully repaired.

Cantilevered electrical connections can bend, causing different angles required for separation. This can affect repeatability of the activation temperature.

Therefore, a reliable and repeatable thermally activated electrical interrupt switch capable of indicating an over-temperature condition is needed.

SUMMARY OF THE INVENTION

The invention is directed to a thermally activated electrical interrupt switch incorporating an optional mechanical reset mechanism.

In one general aspect of the present invention, the thermally activated electrical interrupt switch may include:

a thermally active material that expands when subjected to heat;

an interrupt control rod engaging with said thermally active material in a manner whereby said control rod is moved by the displacement of said thermally active material;

an electrical contact which is operated by the movement of the interrupt control rod; and a reset mechanism that secures the interrupt control rod in location when the apparatus is placed in an interrupt state.

Another aspect of the present invention provides a thermally active material being a liquid, gel, wax, and the like having at least one of a diaphragm interface and a piston interface between the thermal material and the interrupt control rod.

Yet another aspect utilizes a formed disc as the thermally active material, wherein the center of the disc expands outward when heated.

In a further aspect of the present invention, an electrical interrupt circuit is provided via one or more pair of contacts being electrically connected via a circuit controlling contact and/or one or more cantilevered contacts electrically connected to a fixed contact.

In still a further aspect of the present invention, the reset mechanism includes a notch located within the interrupt control rod.

While another aspect places the notch against a holding member, the holding member being selected from a group comprising an edge of a bushing and a reset control rod distal end.

In yet another aspect resets the apparatus via a motion of the reset control rod, the motion being generally perpendicular to the interrupt control rod.

While another aspect incorporates at least one spring for controlling the displacement of at least one of the interrupt control rod and the thermal expanding material.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION OF REPRESENTATIVE EMBODIMENTS

Shown throughout the Figures, the invention is directed to a thermally activated electrical interrupt switch, presenting various deviations of the generic invention.

Figure 1:
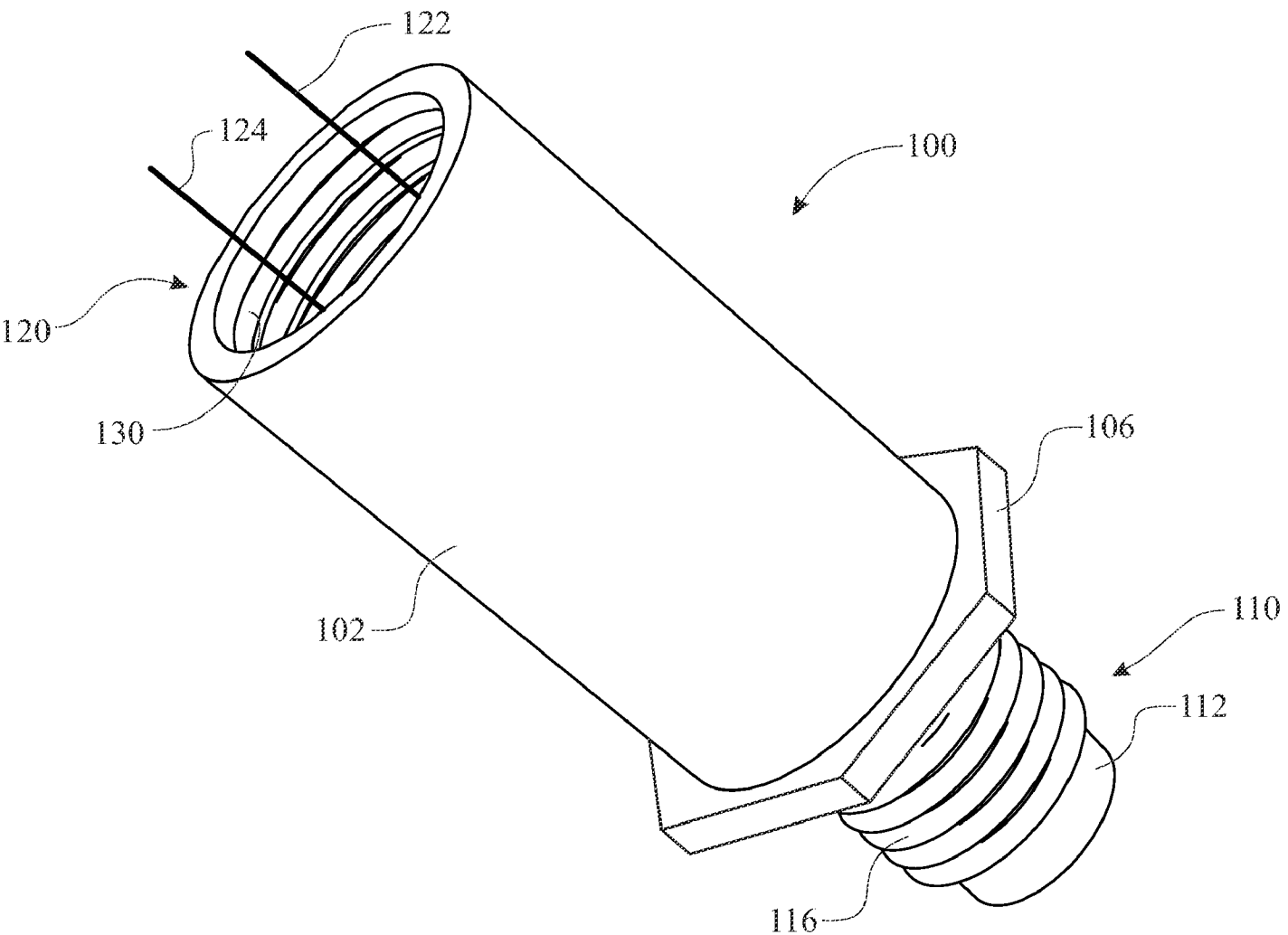
FIG. 1 is an isometric view of a thermally activated electrical interrupt switch.

A thermally activated electrical interrupt apparatus 100 is initially represented in an isometric view illustrated in FIG. 1. The thermally activated electrical interrupt apparatus 100 is configured in two sections; an interrupt housing 102 and a thermal transfer portion 110. The interrupt housing 102 contains the electrical contact functioning portion of the thermally activated electrical interrupt apparatus 100 within a housing cavity 104. The thermal transfer portion 110 contains the thermally active portion of the thermally activated electrical interrupt apparatus 100. The thermal transfer portion 110 is fabricated having a thermal transfer housing portion 112 and a thermal coupling threading 116 for installing the thermally activated electrical interrupt apparatus 100 into a pump or other device. The interrupt housing 102 includes an electrical interface portion 120 for providing electrical communication (via a first electrical conductor 122 and a second electrical conductor 124) between the thermally activated electrical interrupt apparatus 100 and the operating circuit of the monitored pump. An electrical seal threading 130 can be formed (internally as shown or externally) about the electrical interface portion 120, providing a weather seal. An assembly collar 106 is preferably disposed upon the interrupt housing 102 proximate the thermal transfer portion 110 providing a means for tightening the thermal coupling threading 116 during installation. The assembly collar 106 can be of any geometric form factor, preferably being a commonly used hexagonal shape.

Figure 2:
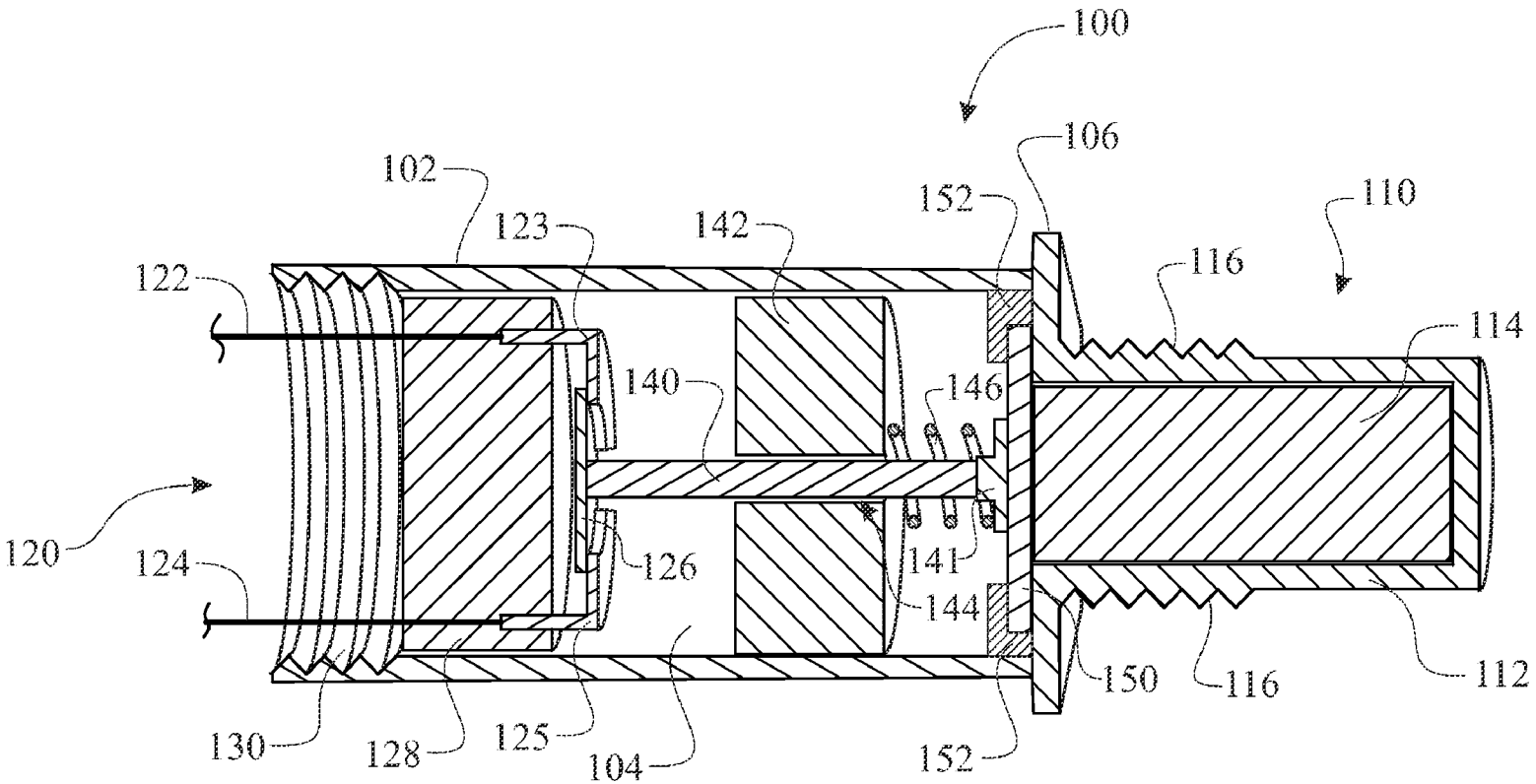
FIG. 2 is a sectioned elevation view of the thermally activated electrical interrupt switch as presented in FIG. 1 being sectioned along the central longitudinal axis, with the switch shown in a closed circuit state.
Figure 3:
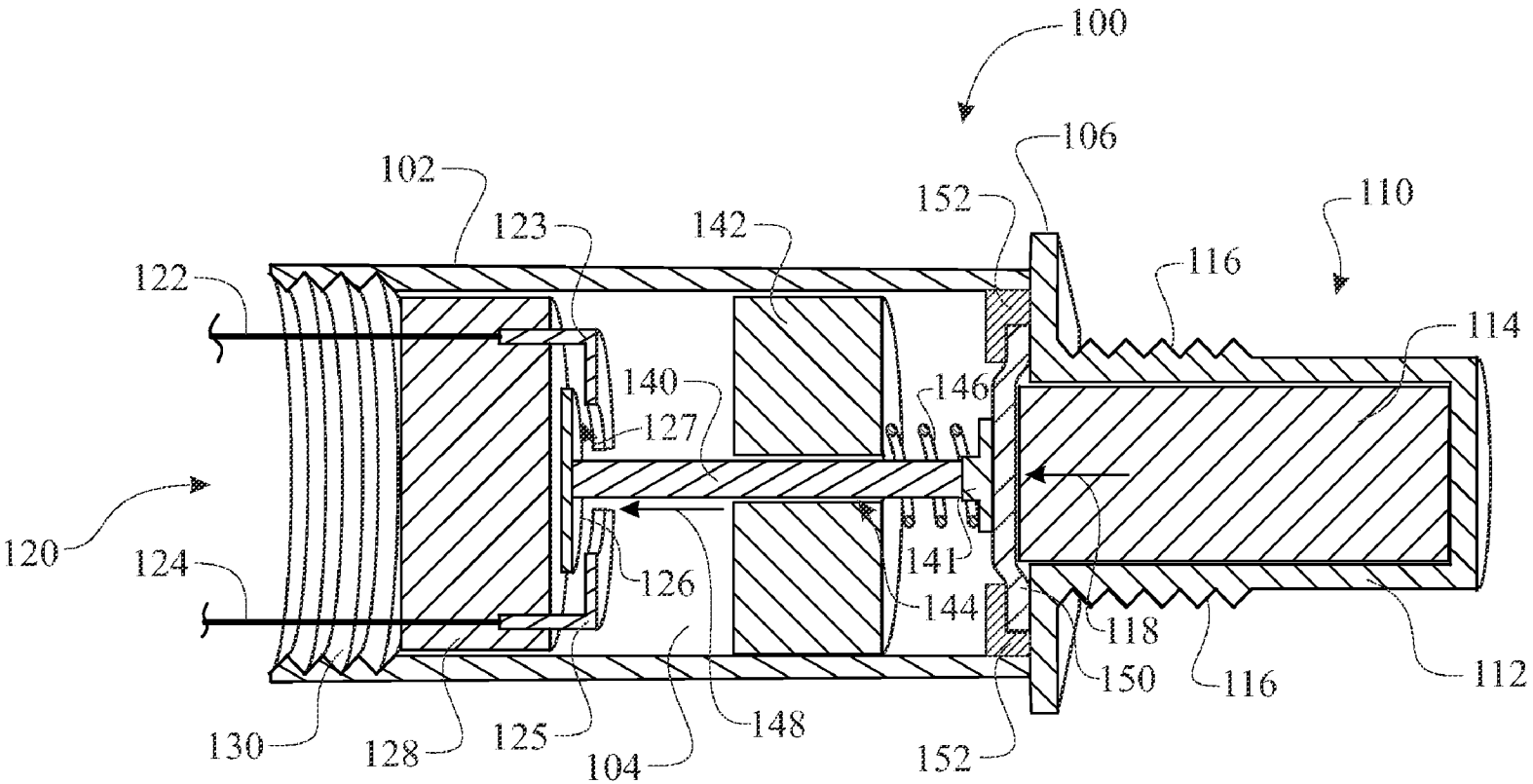
FIG. 3 is a sectioned elevation view of the thermally activated electrical interrupt switch as presented in FIG. 2 shown in a circuit interrupt state.

Functionality of the thermally activated electrical interrupt apparatus 100 is better presented in sectional FIGS. 2 and 3. A thermally expanding material 114 is encapsulated within the thermal transfer housing portion 112, expanding against a compliant member, such as a diaphragm 150. The thermally expanding material 114 can be a liquid, a gel, a wax, and the like, as well as being tailored to a desired temperature range for a desired expansion rate. The diaphragm 150 is a pliant material and secured via a diaphragm collar 152. An interrupt control rod 140 is slideably assembled through a rod passage 144 of a control rod bushing 142. A control rod flange 141 can be formed on the thermal end of the interrupt control rod 140 for an improved interface between the interrupt control rod 140 and the diaphragm 150. A control rod return spring 146 resides between the control rod bushing 142 and the control rod flange 141, ensuring the interrupt control rod 140 remains seated against the diaphragm 150 and exerts contact pressure to ensure a good electrical contact between 126, 125, and 123. A circuit controlling contact 126 is disposed upon the electrically controlling end of the interrupt control rod 140. The circuit controlling contact 126 provides either an electrical circuit (FIG. 2) or an interrupt circuit (FIG. 3) between a first electrical contact 123 and a second electrical contact 125. The interrupt circuit is generated when a contact separation 127 is created between the circuit controlling contact 126 and at least one of the first electrical contact 123 and the second electrical contact 125. The circuit state is conveyed to the monitored device via an electrical communication between the first electrical conductor 122 and the first electrical contact 123/the second electrical conductor 124 and the second electrical contact 125. A circuit mounting member 128 can be incorporated for assembling and maintaining the electrical contacts 123, 125, while additionally providing a watertight/weatherproof seal. The thermally activated electrical interrupt apparatus 100 is operated via a thermal transfer of heat from the monitored device to the thermally expanding material 114 via the thermal transfer housing portion 112. It is preferred the thermal transfer housing portion 112 be of a thermally conductive material such as metal. As the temperature of the thermally expanding material 114 rises, the thermally expanding material 114 expands applying an expansion force 118 to the diaphragm 150. The motion of the diaphragm 150 is transferred to the interrupt control rod 140 (causing an interrupt generating motion 148), separating the circuit controlling contact 126 from the contacts 123, 125 creating the contact separation 127, thus an open circuit. When the thermally expanding material 114 cools, the control rod return spring 146 ensures the interrupt control rod 140, the electrical contact 126, and the diaphragm 150 return to the normal, closed contact state.

Figure 4:
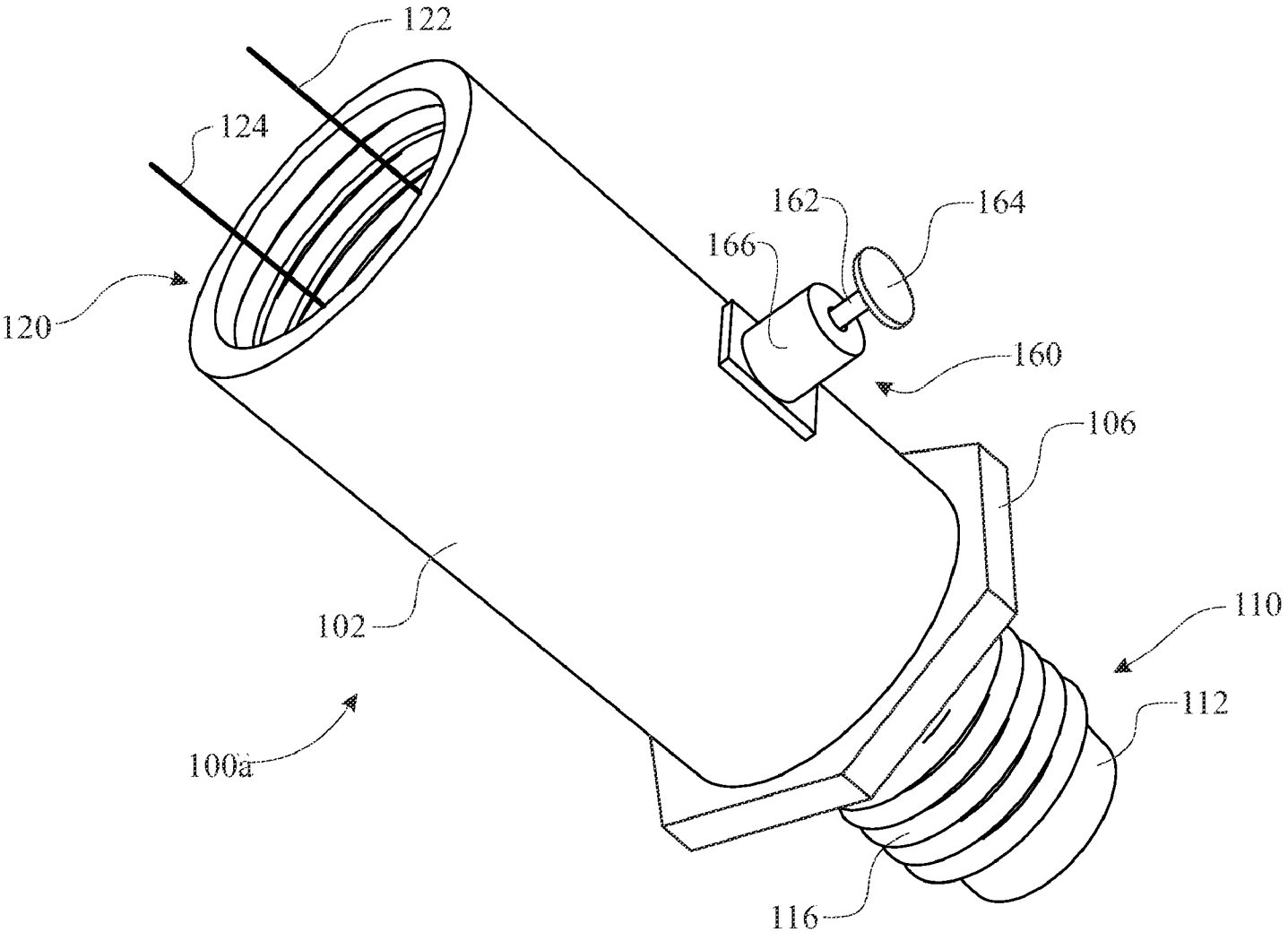
FIG. 4 is an isometric view of a thermally activated electrical interrupt switch, incorporating a reset mechanism.

An enhanced embodiment presenting a thermally activated electrical interrupt apparatus 100*a*, which includes a reset mechanism 160 and is presented as an isometric view in FIG. 4. The reset mechanism 160 provides a reset button 164 as a user interface. The user pulls (or presses as in FIGS. 12-14) the reset button 164, which, in turn, repositions a reset control rod 162. The reset control rod 162 is slideably assembled through a reset mechanism housing 166, which is disposed upon the interrupt housing 102. The engaging portion of the reset mechanism 160 can be provided in a variety of form factors, with several embodiments being presented herein.

Figure 5:
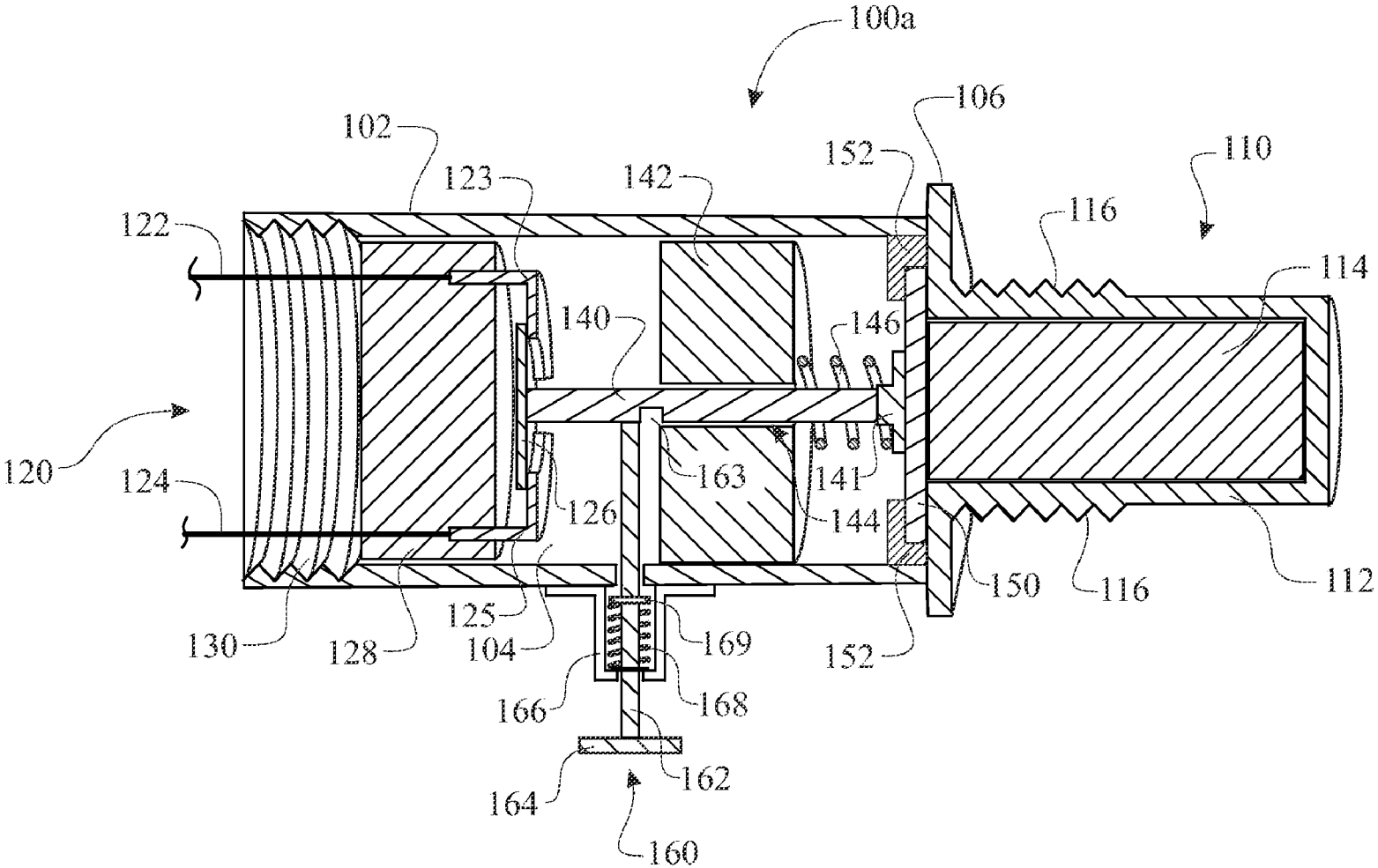
FIG. 5 is a sectioned elevation view of the thermally activated electrical interrupt switch as presented in FIG. 4 being sectioned along the central longitudinal axis, utilizing a thermally operated diaphragm interface with the switch shown in a closed circuit state.
Figure 6:
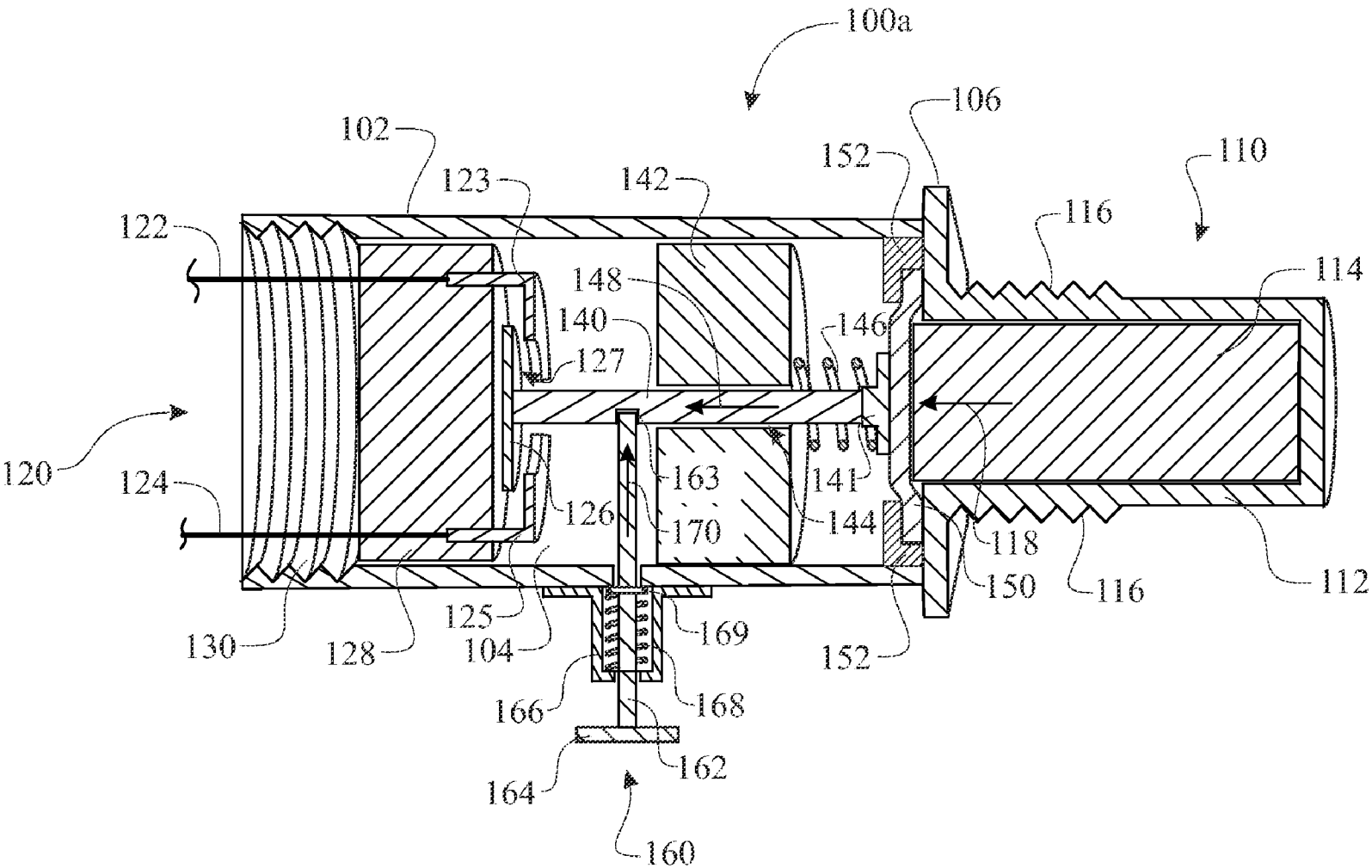
FIG. 6 is a sectioned elevation view of the thermally activated electrical interrupt switch as presented in FIG. 5 shown in a circuit interrupt state.
Figure 7:
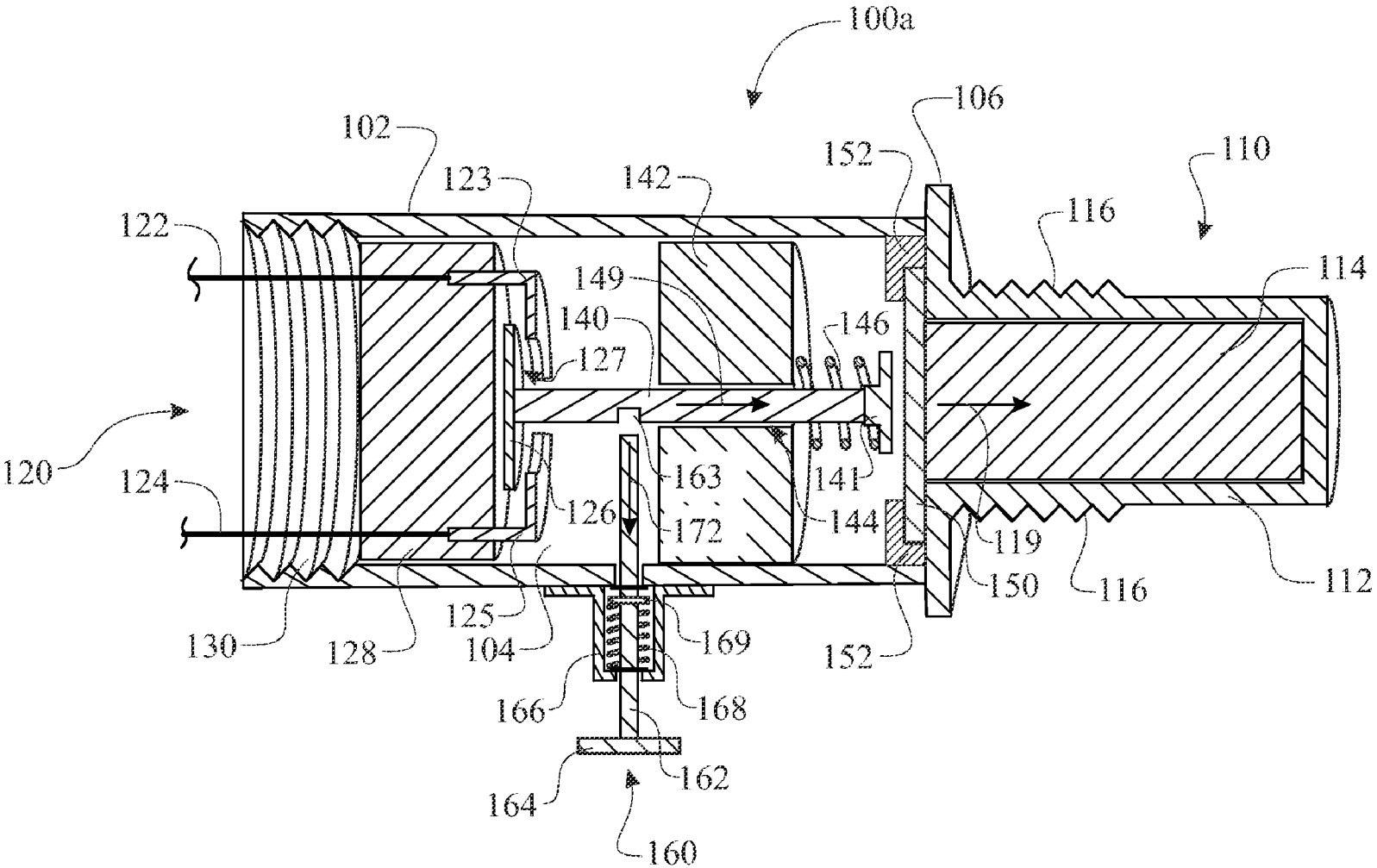
FIG. 7 is a sectioned elevation view of the thermally activated electrical interrupt switch as presented in FIG. 5 shown in a reset state.

A first exemplary embodiment of the reset mechanism 160 is presented in the sectional illustration of FIGS. 5 through 7. A reset engaging notch 163 is formed within the interrupt control rod 140. The reset engaging notch 163 is one example of a reset engaging feature, and can be a notch (as shown), a groove about the interrupt control rod 140, a flange, a projection from the rod, and the like. When the thermally expanding material 114 is heated, it generates an expansion force 118. The expansion force 118 expands the diaphragm 150, causing the interrupt control rod 140 to move in accordance with an interrupt generating motion 148. A reset spring 168 ensures the distal end of the reset control rod 162 remains in communication with the interrupt control rod 140. The reset spring 168 applies the engaging force against a reset spring retaining flange 169, which is affixed to the reset control rod 162. The motion of the interrupt control rod 140 repositions the reset engaging notch 163 until the distal end of the reset control rod 162 engages with reset engaging notch 163 via an inward reset rod motion 170. A contact separation 127 is created between the circuit controlling contact 126 and the contacts 123, 125 in concert with the engagement of the reset control rod 162 and the reset engaging notch 163. When the thermally expanding material 114 cools, the thermally expanding material 114 contracts potentially forming a gap between the control rod flange 141 and the diaphragm 150. The user resets the thermally activated electrical interrupt apparatus 100*a* by pulling the reset button 164 away from the interrupt housing 102, causing the reset control rod 162 to move in accordance with an outward reset rod motion 172, thus disengaging the distal end of the reset control rod 162 and the reset engaging notch 163. The disengagement releases the interrupt control rod 140, which is returned (via a reset motion 149) to a ready state via a return force applied by the control rod return spring 146.

Figure 8:
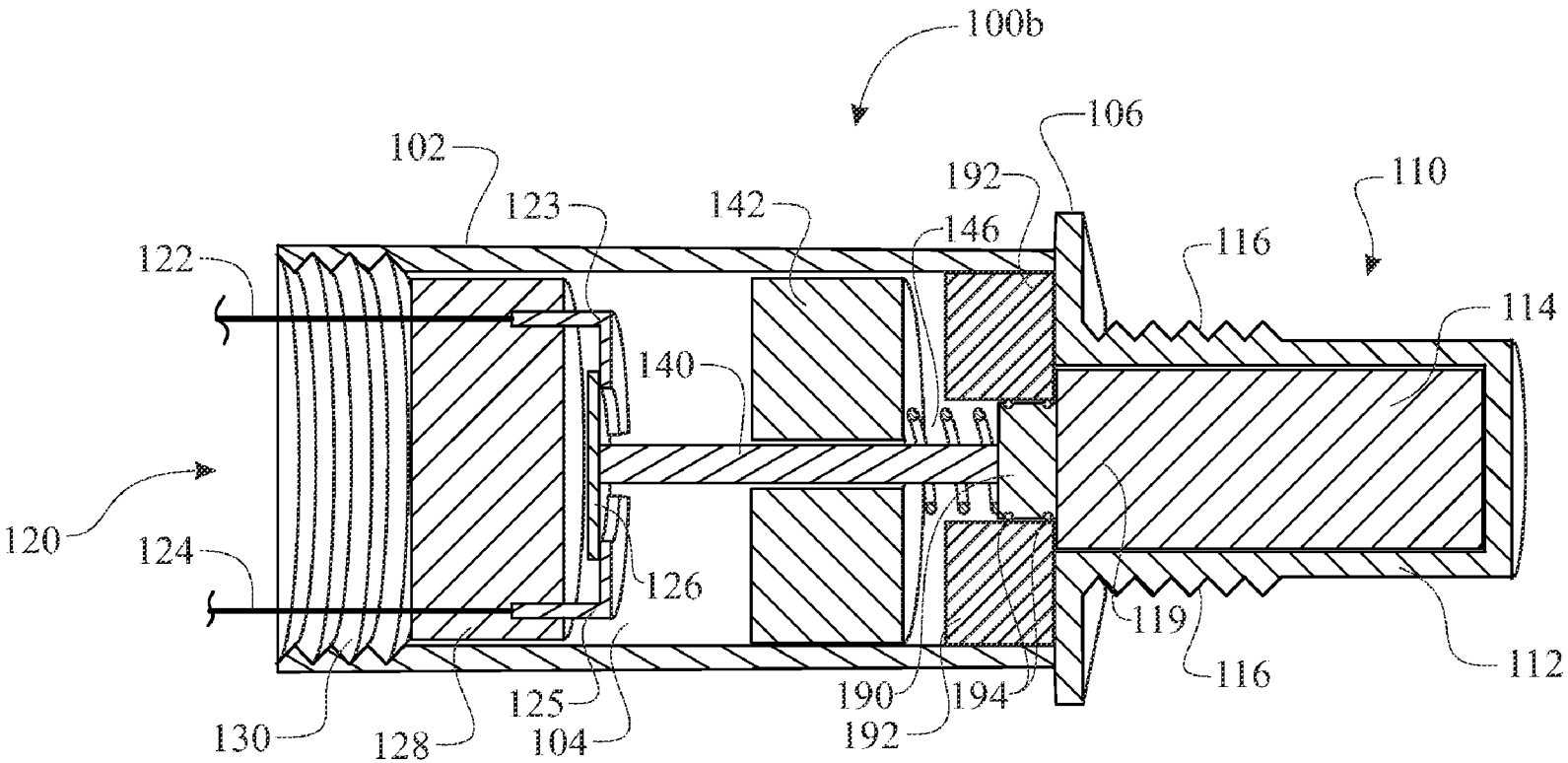
FIG. 8 is a sectioned elevation view of the thermally activated electrical interrupt switch utilizing a thermally operated piston interface with the switch shown in a closed circuit state.
Figure 9:
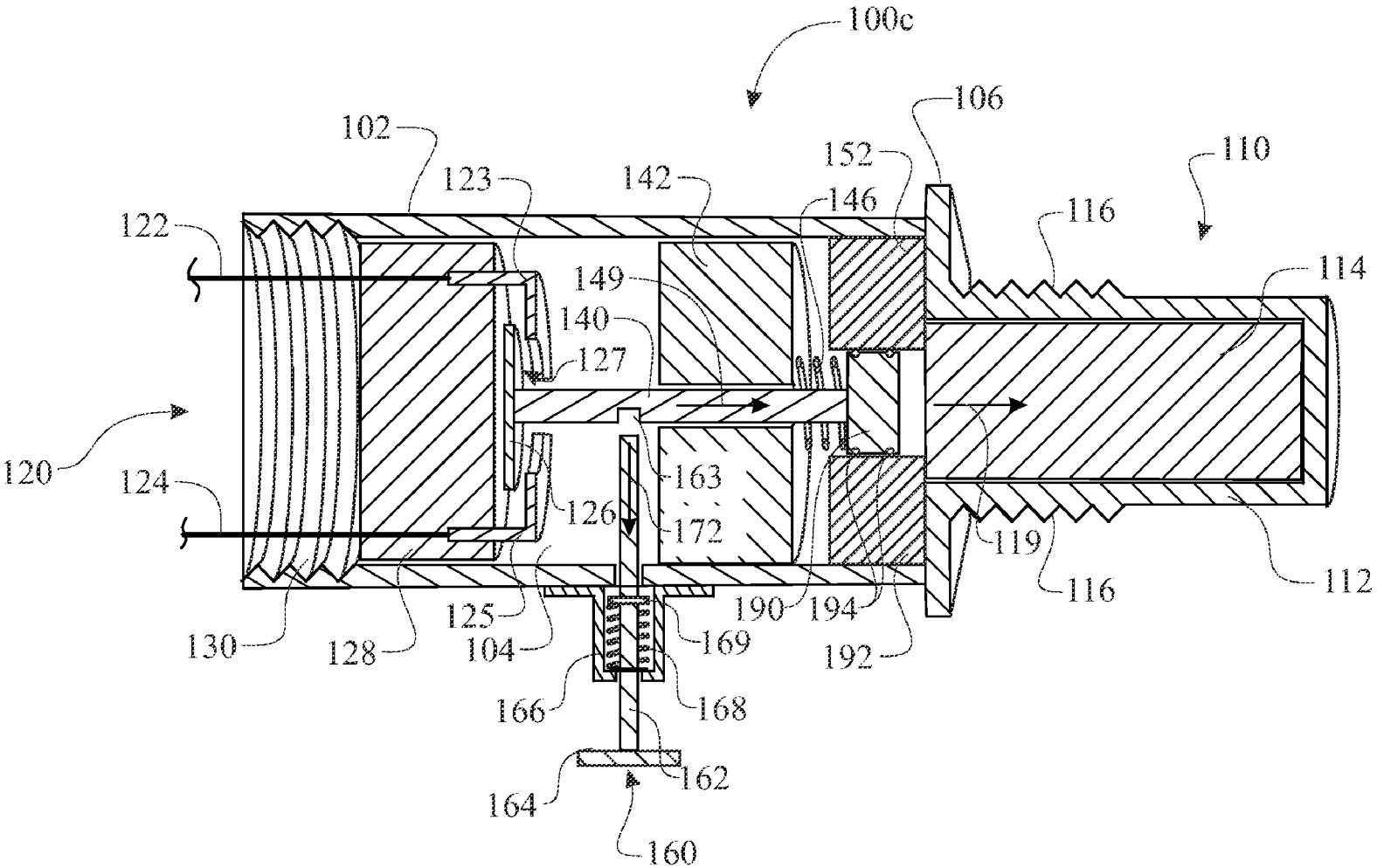
FIG. 9 is a sectioned elevation view of the thermally activated electrical interrupt switch utilizing a thermally operated piston interface incorporating a reset mechanism, with the switch shown in an interrupt state.

Another embodiment utilizes a piston interface (replacing the diaphragm interface previously presented) referenced as a thermally activated electrical interrupt apparatus 100*b* illustrated in FIG. 8. An exemplary illustration of the thermally activated electrical interrupt apparatus 100*b* introduces a multi-diameter interrupt control rod 190 slideably contained within an interrupt control rod notch 192. At least one piston seal 194 (two being shown) is assembled therein, forming a seal between the multi-diameter interrupt control rod 190 and the interrupt control rod notch 192. Alternate seal means can be utilized, including a rubber sleeve, a plastic sleeve, encapsulating the assembly, and any other piston design that is known by those skilled in the art. The piston assembly operates in a manner similar to the diaphragm system previously presented. The interrupt control rod 140 and the multi-diameter interrupt control rod 190 can be independent or coupled. A reset mechanism 160 can be incorporated as illustrated in FIG. 9, functioning as previously presented in FIGS. 5 through 7.

Figure 10:
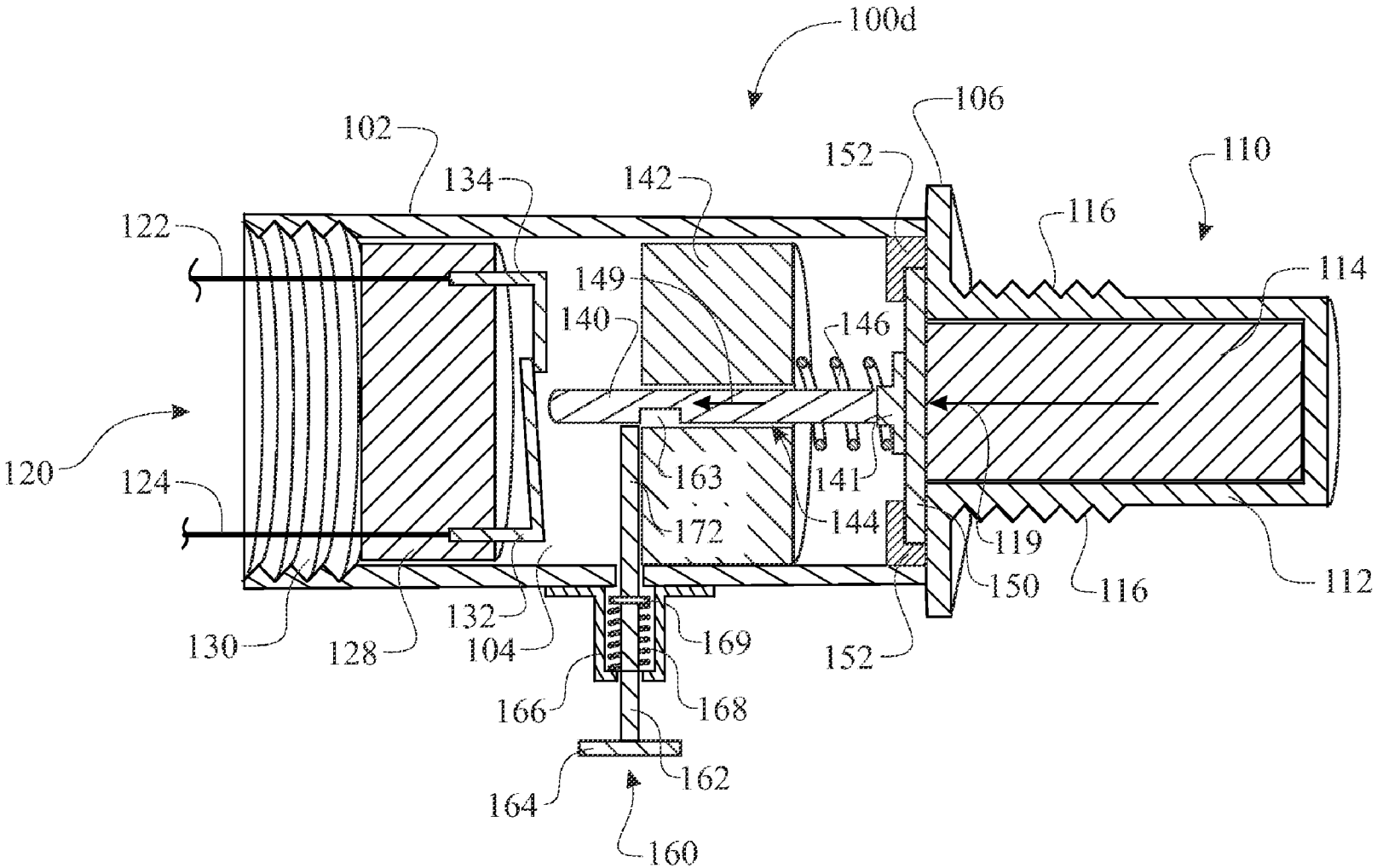
FIG. 10 is a sectioned elevation view of the thermally activated electrical interrupt switch utilizing a cantilevered contact configuration incorporating a reset mechanism, with the switch shown in a closed circuit state.
Figure 11:
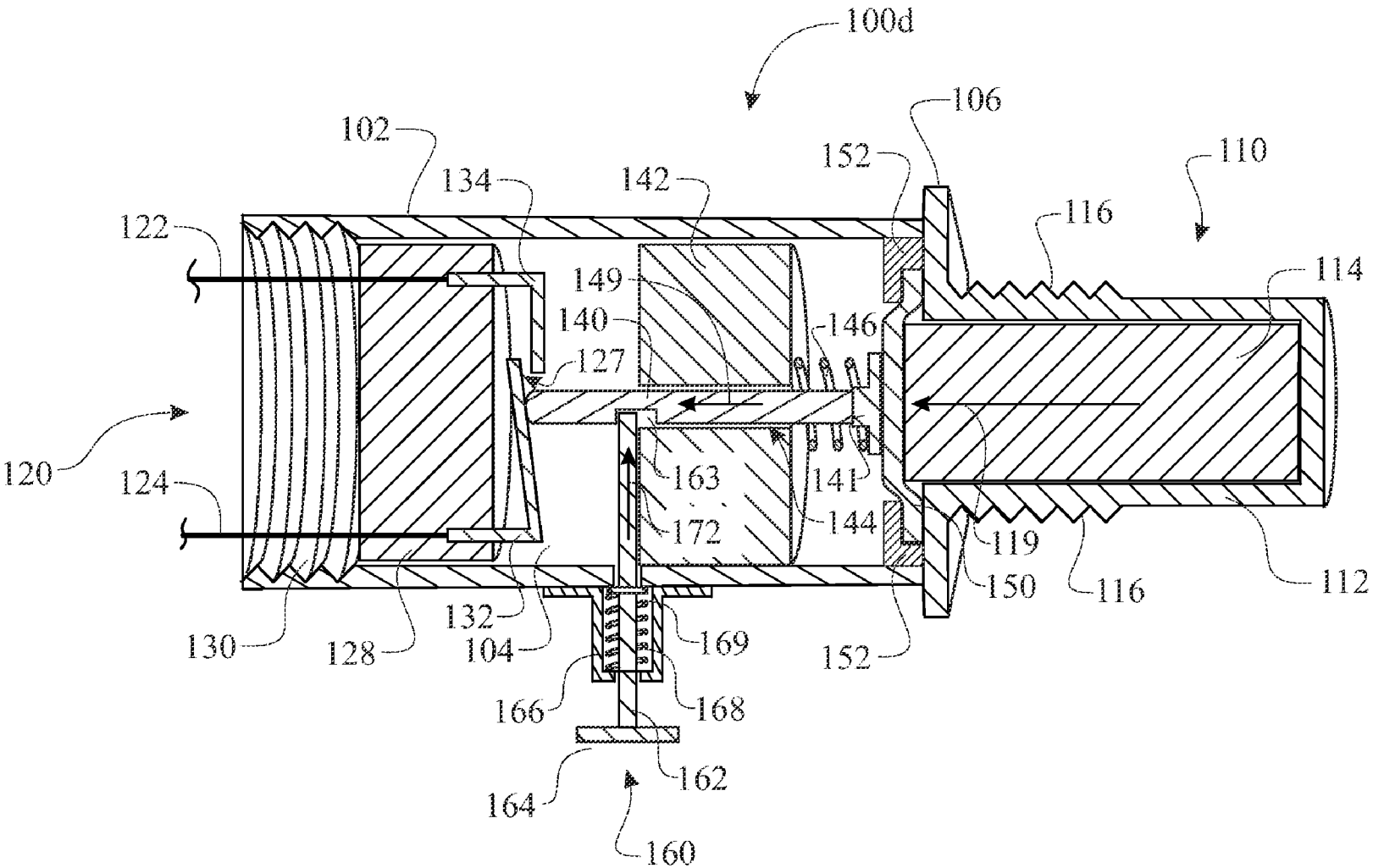
FIG. 11 is a sectioned elevation view of the thermally activated electrical interrupt switch as presented in FIG. 10 shown in an interrupt state.

While another exemplary embodiment, referred to as a thermally activated electrical interrupt apparatus 100*d* illustrated in FIGS. 10 and 11 introduces an alternate electrical contact configuration and a slight variation on the reset mechanism 160. The alternate electrical contact configuration is a cantilevered design, utilizing a cantilevered contact 132 and a fixed contact 134. The fixed contact 134 separates from the cantilevered contact 132 via the reset motion 149 of the interrupt control rod 140, causing the contact separation 127. The illustration shows an adjusted position of the reset mechanism 160, placing the reset control rod 162 adjacent the edge of the control rod bushing 142.

Figure 12:
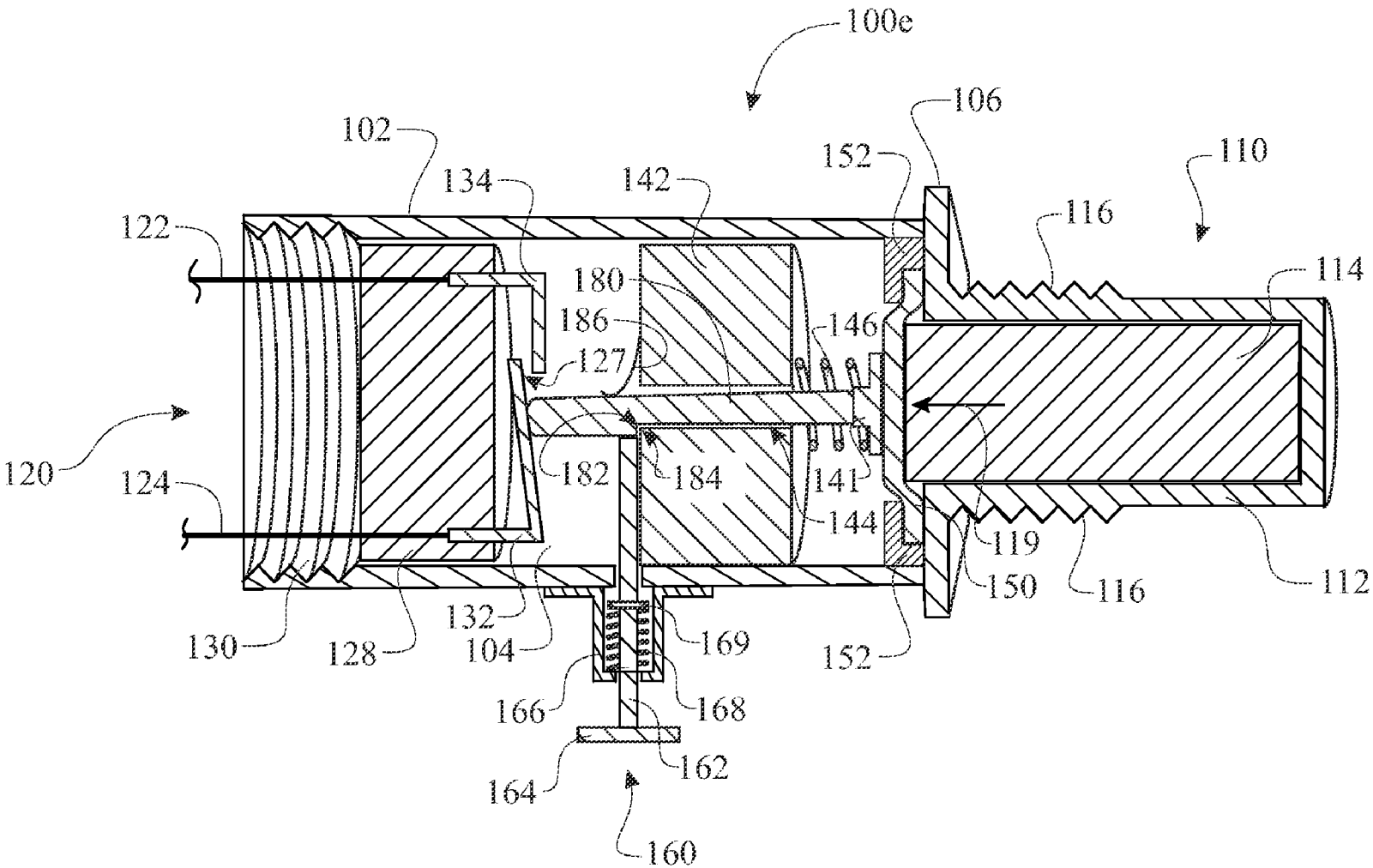
FIG. 12 is a sectioned elevation view of the thermally activated electrical interrupt switch utilizing a notched latching configuration, with the switch shown in an interrupt state.
Figure 13:
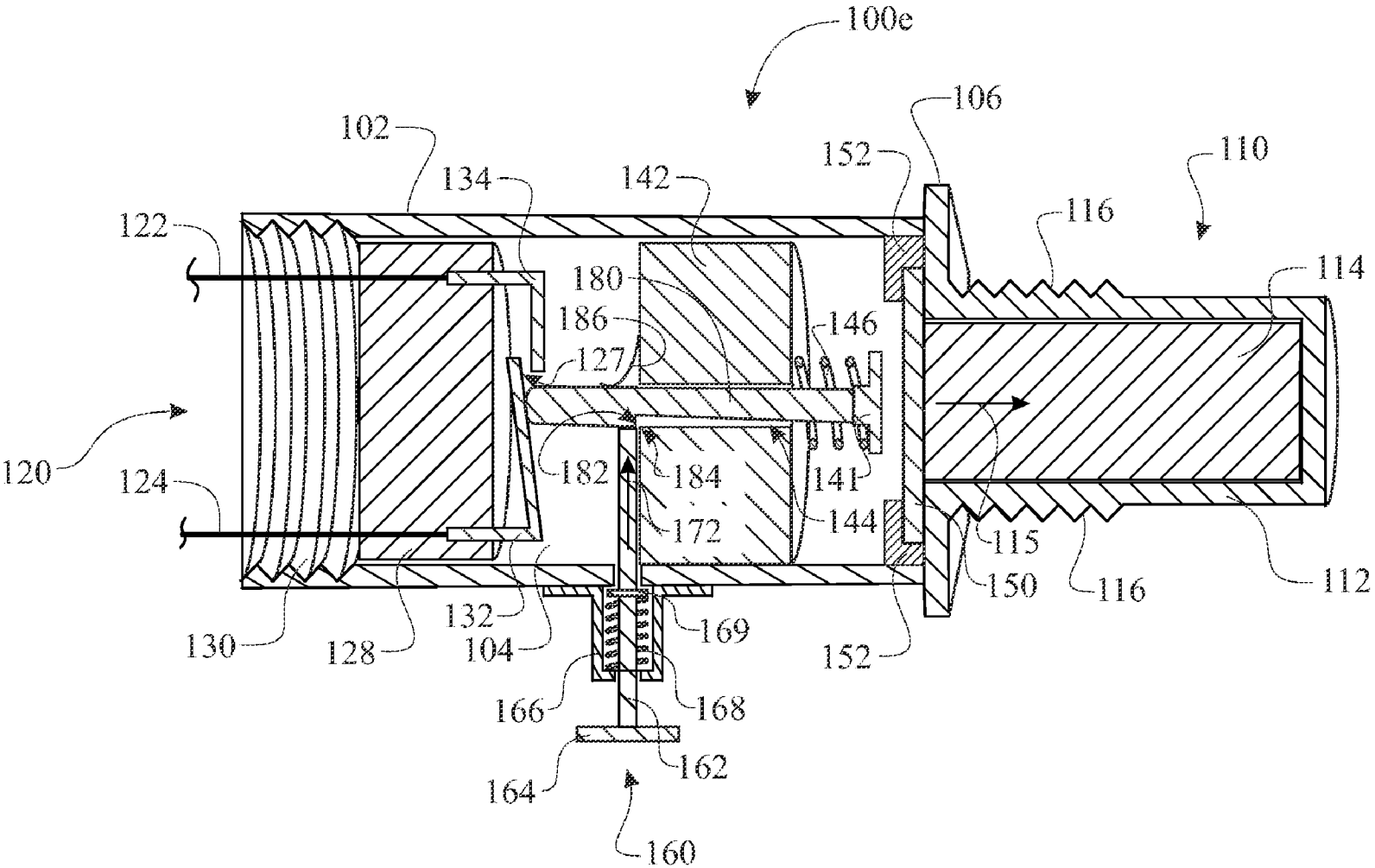
FIG. 13 is a sectioned elevation view of the thermally activated electrical interrupt switch as presented in FIG. 10 showing the reset mechanism activated and the thermal activated material in a cooled state.
Figure 14:
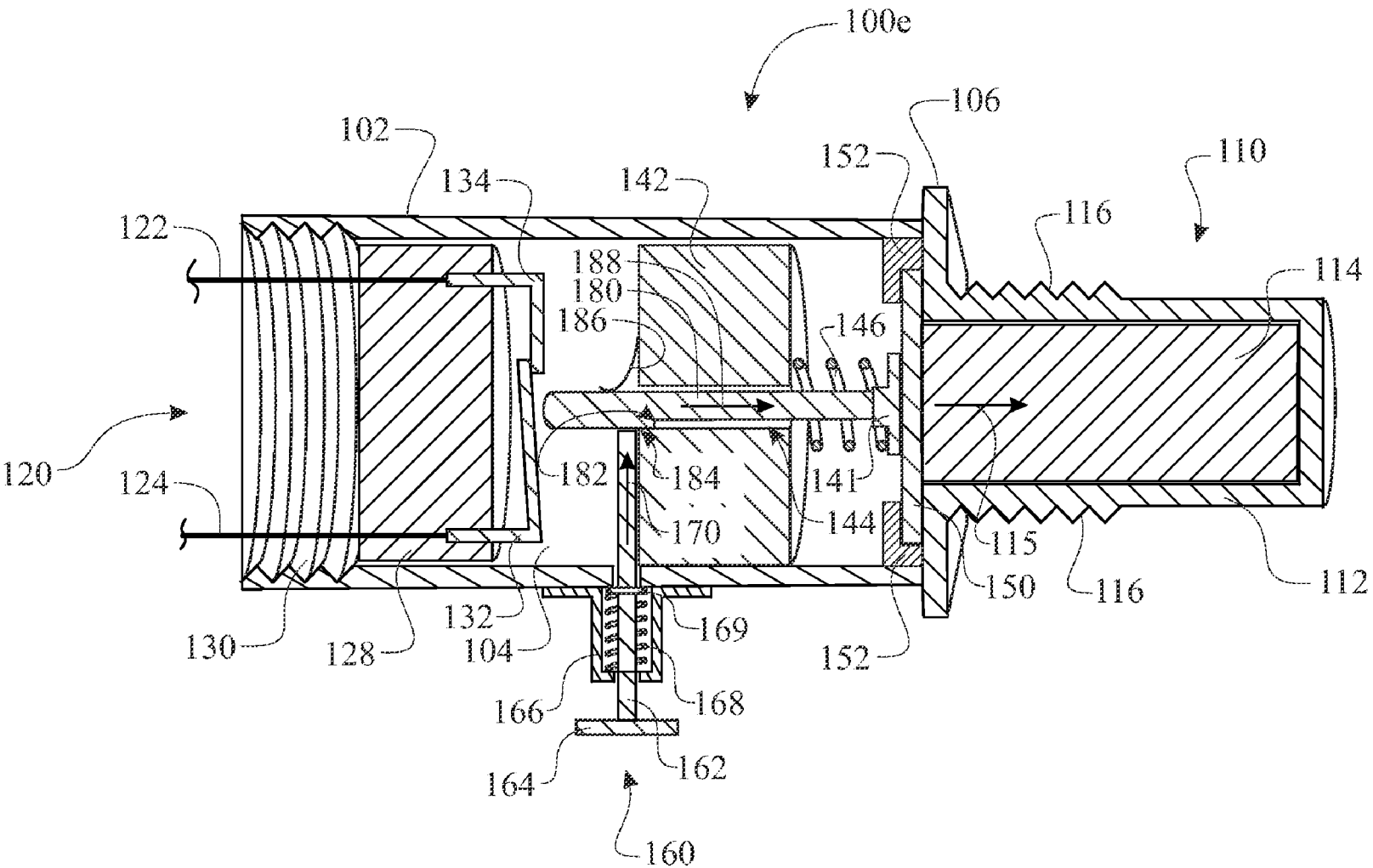
FIG. 14 is a sectioned elevation view of the thermally activated electrical interrupt switch as presented in FIG. 13 shown in a reset state.

With yet another exemplary embodiment, referred to as a thermally activated electrical interrupt apparatus 100*e* illustrated in FIG. 12 through 14 introduces an alternate latching configuration for the reset mechanism, wherein an offset notched interrupt rod 180 includes an offset notch 182 which engages with a bushing reset interface 184 of the control rod bushing 142 an engaging spring 186 rides along the offset notched interrupt rod 180 on a side opposing the offset notch 182, providing a downward force to the offset notched interrupt rod 180, ensuring the offset notch 182 engages with the bushing reset interface 184. As the thermally expanding material 114 cools, the material shrinks. The diaphragm 150 causes the shrinking thermally expanding material 114 to move in accordance with a contracting motion 115. The rod 180 remains engaged with the bushing reset interface 184 until reset by the reset mechanism 160. The offset notch 182 disengages from the bushing reset interface 184 via an inward reset rod motion 170 of the reset control rod 162, then returns to a monitoring state via an interrupt rod reset motion 188.

Figure 15:
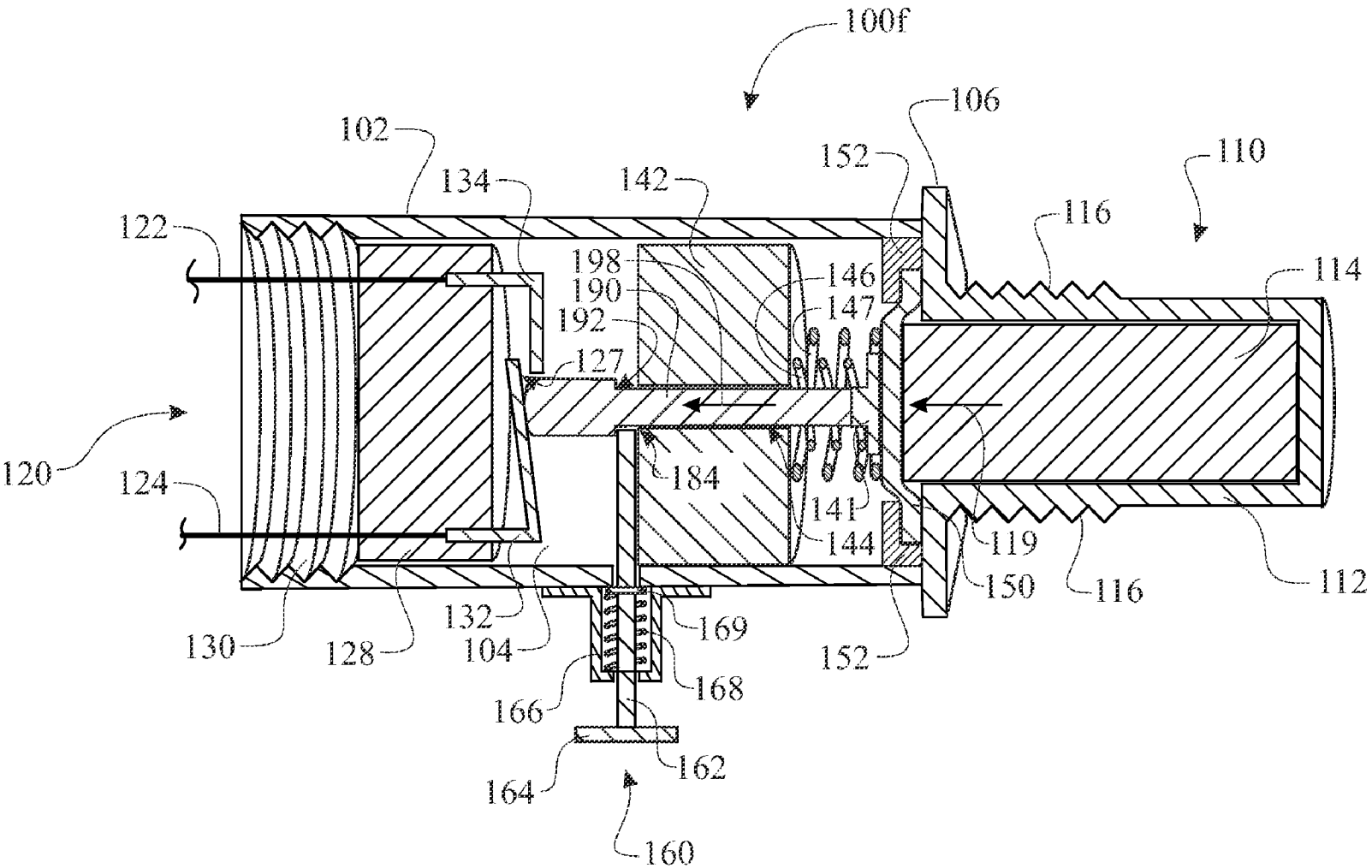
FIG. 15 is a sectioned elevation view of the thermally activated electrical interrupt switch utilizing a stepped interrupt control rod configuration, with the switch shown in an interrupt state.
Figure 16:
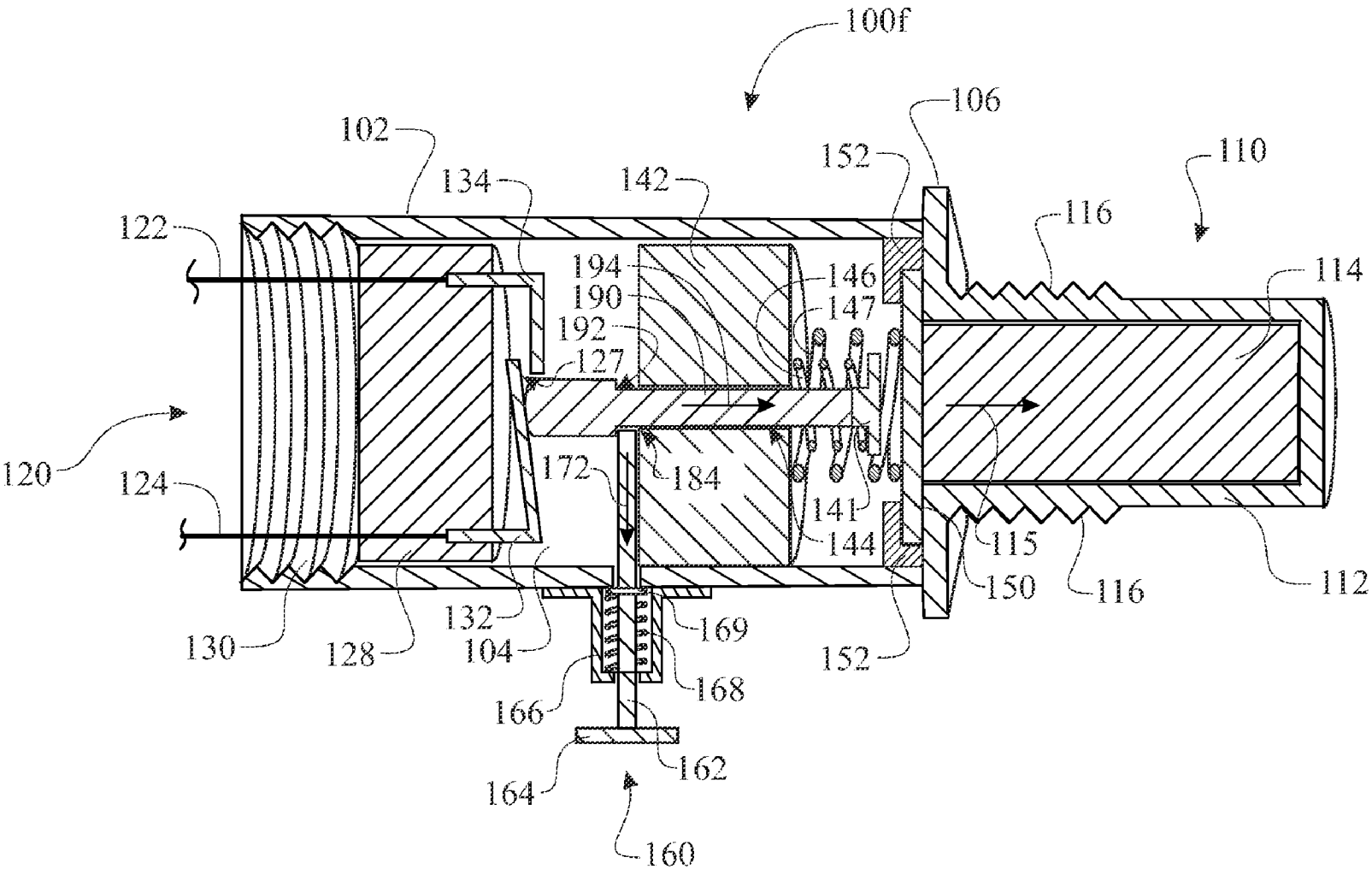
FIG. 16 is a sectioned elevation view of the thermally activated electrical interrupt switch as presented in FIG. 15 showing the reset mechanism activated and the thermal activated material in a cooled state.
Figure 17:
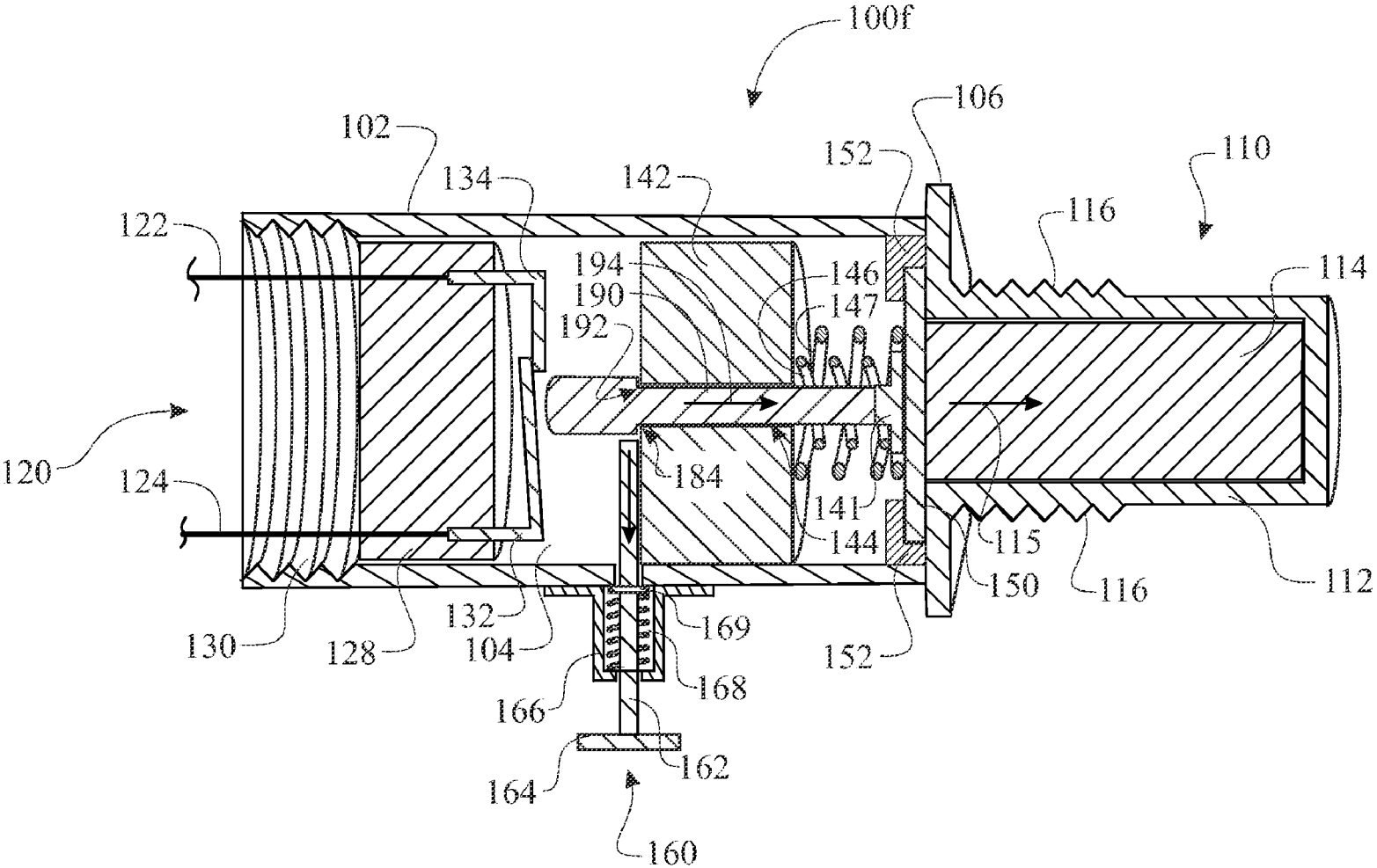
FIG. 17 is a sectioned elevation view of the thermally activated electrical interrupt switch as presented in FIG. 15 shown in a reset state.

With another exemplary embodiment, referred to as a thermally activated electrical interrupt apparatus 100*f* illustrated in FIG. 15 through 17 introduces yet another alternate latching configuration for the reset mechanism, wherein a multi-diameter interrupt control rod 190 includes an interrupt control rod notch 192 which engages with a bushing reset interface 184 of the control rod bushing 142. The multi-diameter interrupt control rod 190 is fabricated having two sections: a sliding shaft size diameter placed within the rod passage 144, and a larger activation diameter, with an interrupt control rod notch 192 at the transition between the two diameters. When the thermally expanding material 114 is heated, the multi-diameter interrupt control rod 190 moves via a control rod interrupt motion 198 and the interrupt control rod notch 192 of the multi-diameter interrupt control rod 190 engages with the distal end of the reset control rod 162 creating an open circuit between the two contacts 132, 134. The open circuit interrupts power to the motor or pump, allowing it to cool. As the motor cools, the thermally expanding material 114 cools, thus contracting. A thermal material return spring 147 is positioned between a wall of the control rod bushing 142 and the diaphragm collar 152, compressing the diaphragm 150 as the thermally expanding material 114 contracts. A gap is created between the diaphragm 150 and the control rod flange 141 of the multi-diameter interrupt control rod 190. Once in an interrupt state, the user can pull the reset button 164, causing an outward reset rod motion 172 of the reset control rod 162. When the distal end of the reset control rod 162 is removed from the interrupt control rod notch 192, the multi-diameter interrupt control rod 190 is returned (via a piston seals 194) to a monitoring state by a return force applied by the control rod return spring 146.

Figure 18:
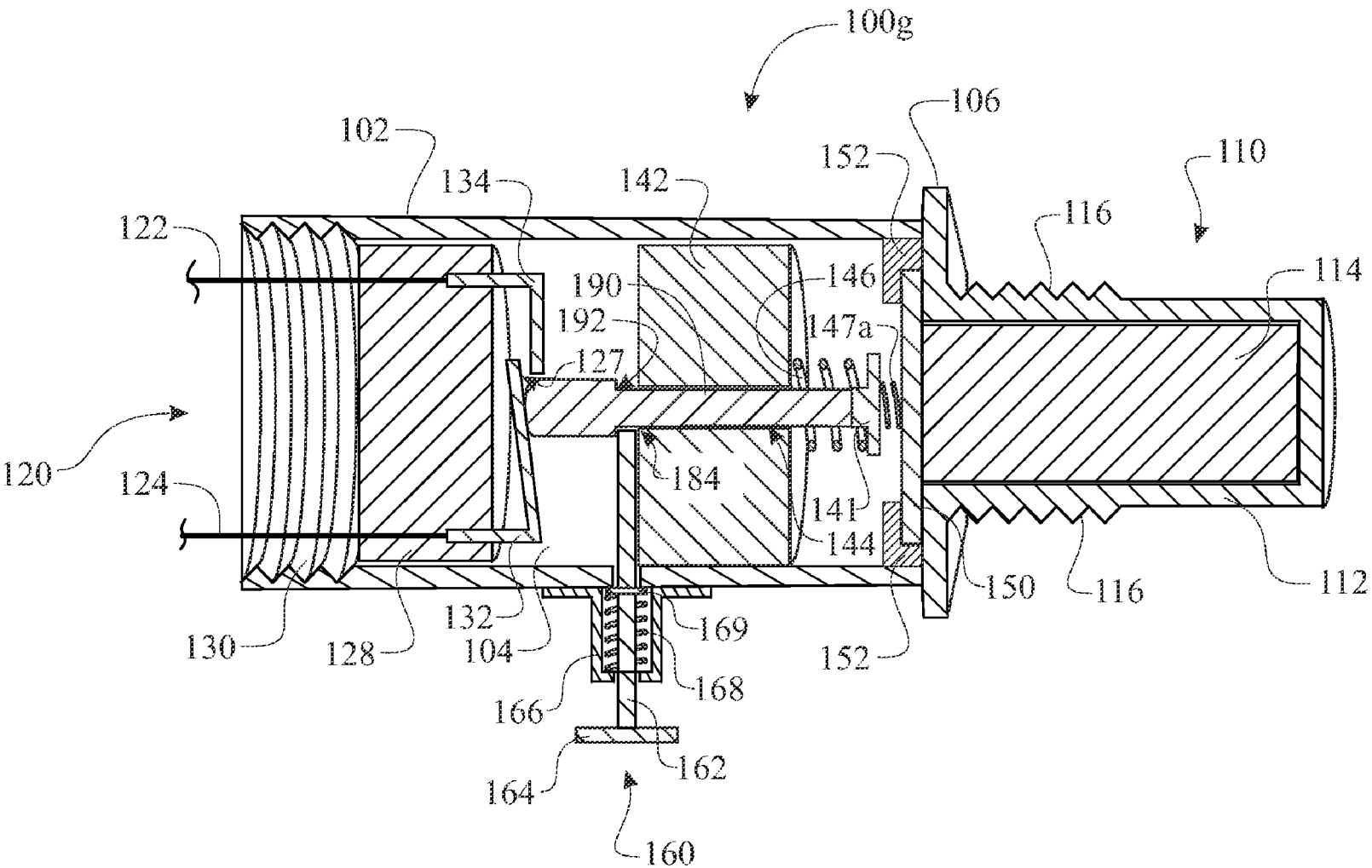
FIG. 18 is a sectioned elevation view of the thermally activated electrical interrupt switch illustrating an alternate interrupt rod return spring configuration.

An alternate to the configuration shown in FIGS. 15 through 17 utilizes a thermal material return spring 147*a* placed between the control rod flange 141 of the control rod (control rod 190 is presented as an exemplary embodiment, whereas it is recognized that any control rod can be used) and the diaphragm 150, as presented in thermally activated electrical interrupt apparatus 100*g* of FIG. 18. It is recognized that any of the various configurations for ensuring the expansion portion of the thermally activated electrical interrupt apparatus 100 returns to a contracted state.

Figure 19:
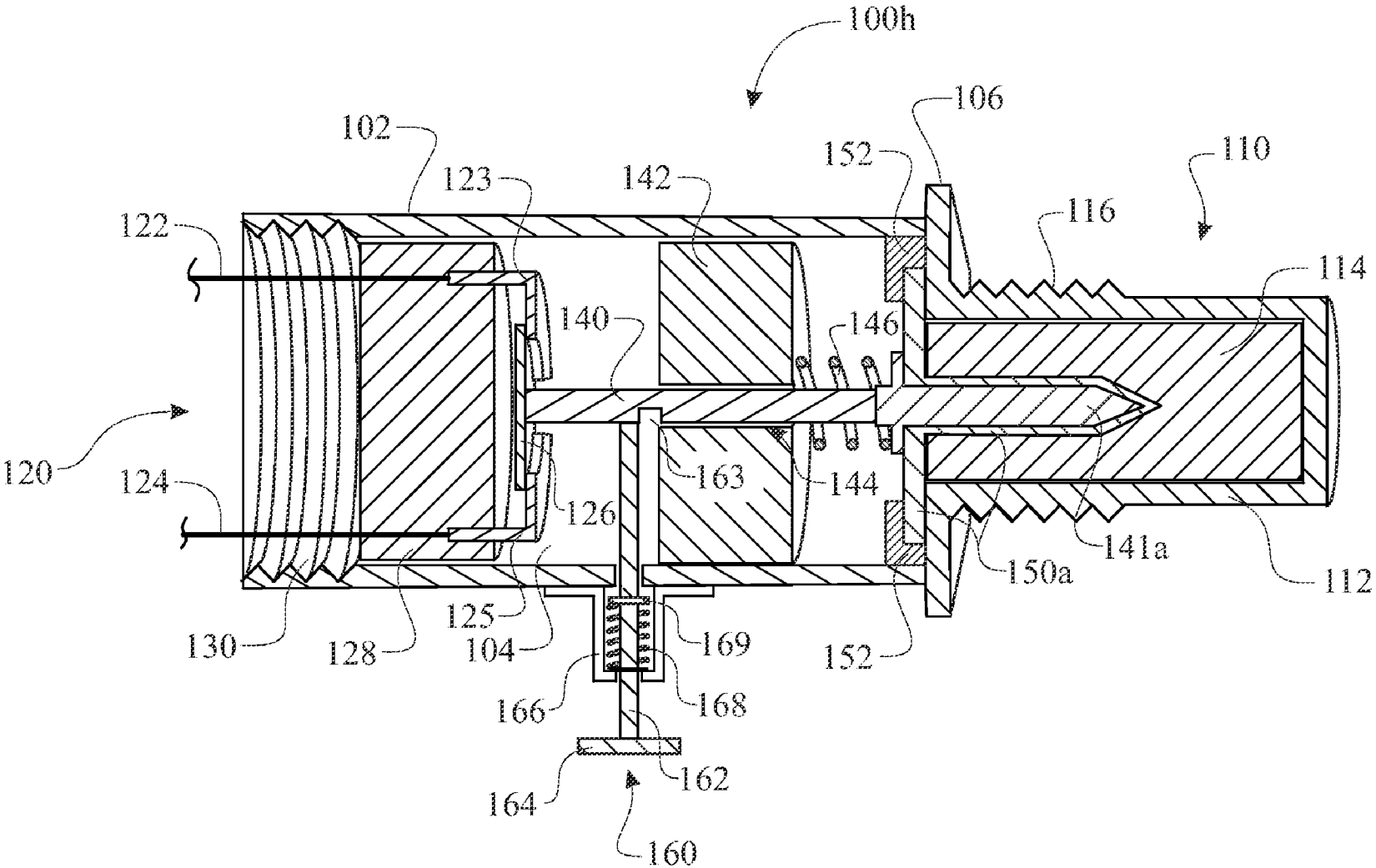
FIG. 19 is a sectioned elevation view of the thermally activated electrical interrupt switch illustrating an alternate diaphragm/piston interface configuration.

A hybrid thermal interface configuration is presented as a thermally activated electrical interrupt apparatus 100*h* of FIG. 19. The hybrid configuration incorporates a formed version of the diaphragm 150*a* having a protrusion that displaces thermally expanding material 114 within the thermal transfer housing portion 112. The control rod flange 141*a* is formed including an elongated portion which contours to the protrusion of the diaphragm 150*a*. It is recognized other configurations can be utilized without deviating from the spirit and intent of the present invention.

Several variations of a thermal motion conveyance mechanism have been described in detail herein, one using a diaphragm 150, another using a multi-diameter interrupt control rod 190, and yet another using a hybrid configuration. It is recognized that other thermal expanding configurations such as a thermal expansion disc can be utilized for the thermally activated portion of the thermally activated electrical interrupt apparatus 100. The Inventor additionally discloses a design wherein the expanding section of the thermal housing can be necked down or tapered, thus, increasing the expanding distance over the same temperature range. Essentially, the smaller the diameter of the thermally expanding material section at the diaphragm or piston location, the larger the distance the control rod travels.

Two contact designs have been shown herein. It is recognized other contact designs which are controlled via a control rod can be utilized maintaining the spirit and intent of the present invention.

The reset mechanism 160 depicted herein is manually operated. Those skilled in the art can automate the reset mechanism 160, including a provision for documenting each interrupt cycle. Additionally, the automation can include a notification process, such as a delivery of a text message, voice message, email, and the like.

Figure 20:
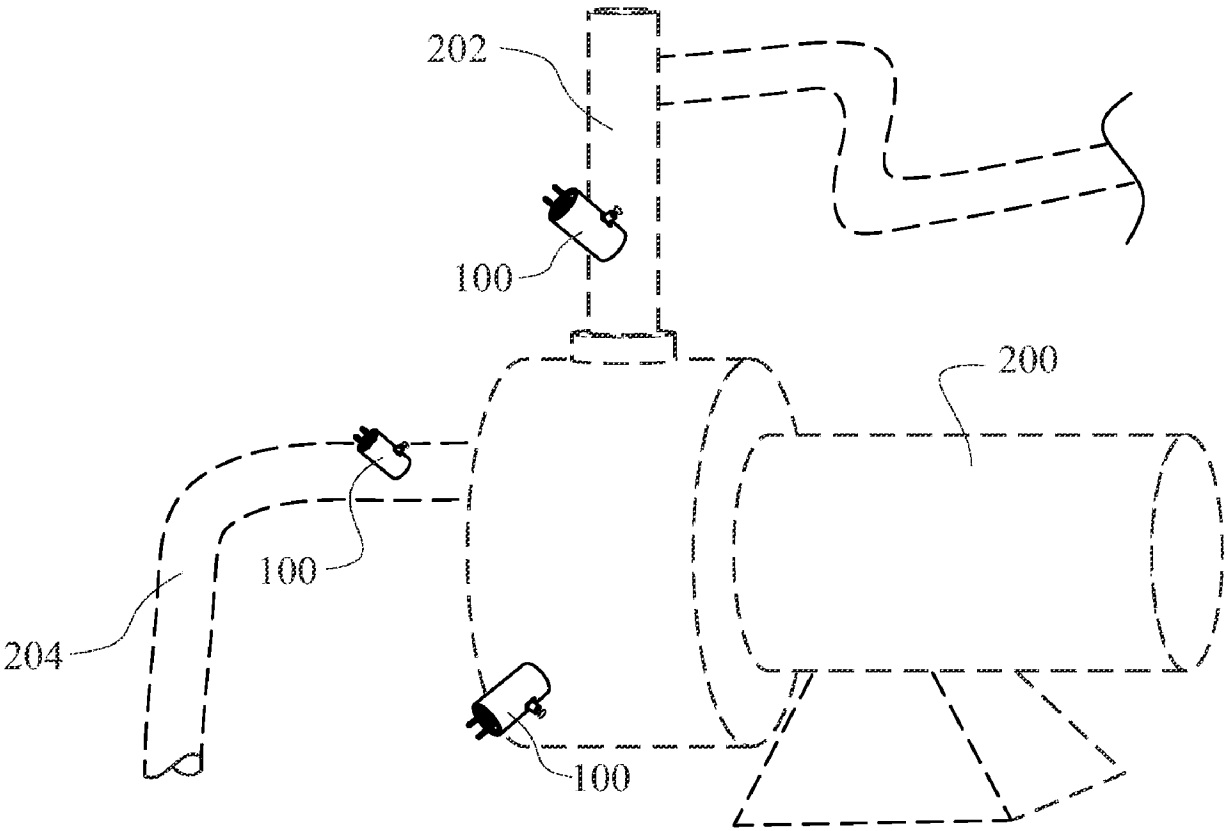
FIG. 20 is an isometric view illustrating an exemplary application of the thermally activated electrical interrupt switch.

An exemplary application of the thermally activated electrical interrupt apparatus 100 is presented in FIG. 20. The thermally activated electrical interrupt apparatus 100 is inserted into either an inlet piping 202, an exit piping 204, or a section of the pump 200. The electrical outputs 122, 124 would be connected in series to the power control circuit of the pump 200. If a plurality of interrupt devices 100 are used, they would be placed in series or a prescribed by the user.

While the preferred embodiments of the invention have been described above, it will be recognized and understood that various modifications can be made in the invention and the appended claims are intended to cover all such modifications which may fall within the spirit and scope of the invention.

We claim:

1. A thermally activated electrical interrupt switch, the switch comprising:

an electrical contact configuration operated by an axial motion of an interrupt control rod;

a thermally activated material in operational communication with said interrupt control rod, wherein said thermally activated material expands when heated and thrusts said interrupt control rod axially; and a reset mechanism that engages substantially perpendicularly with a feature in said interrupt control rod, securing said electrical contact configuration in an interrupt state requiring an external action to release said reset mechanism and reset said switch from said interrupt state, said reset mechanism including a reset control rod and a spring biasing said reset control rod against said interrupt control rod wherein said spring further biases said reset control rod to substantially perpendicularly engage said interrupt control rod feature when said interrupt control rod is thrust axially and whereby said reset control rod when substantially perpendicularly engaged with said interrupt control rod feature maintains said interrupt control rod in its thrust position until said reset control rod is manually disengaged from said feature by said external action, wherein said external action comprises pulling the reset control rod away from the electrical interrupt switch, thereby disengaging a distal end of the reset control rod from the feature in said interrupt control rod.

2. A thermally activated electrical interrupt switch as recited in claim 1, the interrupt control rod feature further comprising a notch, and the reset mechanism operating whereby the interrupt control rod adjusts axially and the notch engages against a feature from a group of reset engaging features, the group consisting of the reset control rod and a bushing reset interface.

3. A thermally activated electrical interrupt switch as recited in claim 2, the switch further comprising an interrupt engaging spring.

4. A thermally activated electrical interrupt switch as recited in claim 3, wherein the interrupt engaging spring is at least one of engaging with the interrupt control rod and engaging with the reset control rod.

5. A thermally activated electrical interrupt switch as recited in claim 1, wherein the thermally activated material operates a thermal motion conveyance mechanism, the thermal motion conveyance mechanism being selected from a group consisting of a diaphragm, a piston, and a thermal expansion disc.

6. A thermally activated electrical interrupt switch as recited in claim 1, wherein the electrical contact configuration is selected from a group consisting of:

a) a first contact, a second contact, and a circuit controlling contact disposed between the first and second contacts; and b) a fixed contact and a cantilevered contact.

7. A thermally activated electrical interrupt switch, the switch comprising:

an electrical contact configuration operated by an axial motion of an interrupt control rod;

a thermally activated material encapsulated within a thermal transfer housing having a mechanically adjusting interface in operational communication with said interrupt control rod, wherein said thermally activated material expands when heated and thrusts said interrupt control rod axially; and a reset mechanism that engages substantially perpendicularly with a feature in said interrupt control rod, securing said electrical contact configuration in an interrupt state requiring an external action to release said reset mechanism and reset said switch from said interrupt state, said reset mechanism including a reset control rod and a spring biasing said reset control rod against said interrupt control rod wherein said spring further biases said reset control rod to substantially perpendicularly engage said interrupt control rod feature when said interrupt control rod is thrust axially and whereby said reset control rod when substantially perpendicularly engaged with said interrupt control rod feature maintains said interrupt control rod in its thrust position until said reset control rod is manually disengaged from said feature by said external action, wherein said external action comprises pulling the reset control rod away from the electrical interrupt switch, thereby disengaging a distal end of the reset control rod from the feature in said interrupt control rod.

8. A thermally activated electrical interrupt switch as recited in claim 7, the interrupt control rod feature further comprising a notch, and the reset mechanism operating whereby the interrupt control rod adjusts axially and the notch engages against a feature from a group of reset engaging features, the group consisting of the reset control rod and a bushing reset interface.

9. A thermally activated electrical interrupt switch as recited in claim 8, the switch further comprising an interrupt engaging spring.

10. A thermally activated electrical interrupt switch as recited in claim 9, wherein the interrupt engaging spring is at least one of engaging with the interrupt control rod and engaging with the reset control rod.

11. A thermally activated electrical interrupt switch as recited in claim 7, wherein the thermally activated material operates a thermal motion conveyance mechanism, the thermal motion conveyance mechanism being selected from a group consisting of a diaphragm and a piston.

12. A thermally activated electrical interrupt switch as recited in claim 7, wherein the electrical contact configuration is selected from a group consisting of:

a) a first contact, a second contact, and a circuit controlling contact disposed between the first and second contacts; and b) a fixed contact and a cantilevered contact.

13. A thermally activated electrical interrupt switch, the switch comprising:

an electrical contact configuration operated by an axial motion of an interrupt control rod;

a thermally activated material in operational communication with said interrupt control rod, wherein said thermally activated material expands when heated and thrusts said interrupt control rod axially; and a reset mechanism that engages substantially perpendicularly with a notch in said interrupt control rod, securing said electrical contact configuration in an interrupt state requiring an external action to release said reset mechanism and reset said switch from said interrupt state, said reset mechanism including a reset control rod and a spring biasing said reset control rod against said interrupt control rod wherein said spring further biases said reset control rod to substantially perpendicularly engage said interrupt control rod notch when said interrupt control rod is thrust axially and whereby said reset control rod when substantially perpendicularly engaged with said interrupt control rod notch maintains said interrupt control rod in its thrust position until said reset control rod is manually disengaged from said notch by said external action, wherein said external action comprises pulling the reset control rod away from the electrical interrupt switch, thereby disengaging a distal end of the reset control rod from the notch in said interrupt control rod.

14. A thermally activated electrical interrupt switch as recited in claim 13, the reset mechanism operating whereby the interrupt control rod adjusts axially and the notch engages against a feature from a group of reset engaging features, the group consisting of the reset control rod and a bushing reset interface.

15. A thermally activated electrical interrupt switch as recited in claim 14, the switch further comprising an interrupt engaging spring.

16. A thermally activated electrical interrupt switch as recited in claim 15, wherein the interrupt engaging spring is at least one of engaging with the interrupt control rod and engaging with the reset control rod.

17. A thermally activated electrical interrupt switch as recited in claim 13, wherein the thermally activated material operates a thermal motion conveyance mechanism, the thermal motion conveyance mechanism being selected from a group consisting of a diaphragm, a piston, and a thermal expansion disc.

* * * * *